United States Patent [19]

Mansfield

[11] 4,440,076

[45] Apr. 3, 1984

[54] SYSTEM FOR IMPROVING EFFICIENCY OF SCREW PRESSES

[76] Inventor: Pete W. Mansfield, 1861 Meadow Ct., West Palm Beach, Fla. 33406

[21] Appl. No.: 346,495

[22] Filed: Feb. 8, 1982

[51] Int. Cl.[3] ..... B30B 9/14

[52] U.S. Cl. ..... 100/117; 100/145

[58] Field of Search ..... 100/117, 145–150, 100/127–129

[56] References Cited

U.S. PATENT DOCUMENTS

| | | | |
|---|---|---|---|
| 3,980,013 | 9/1976 | Bredeson | 100/117 |
| 3,998,148 | 12/1976 | Mainka et al. | 100/117 |
| 4,223,601 | 9/1980 | Knuth et al. | 100/117 |

FOREIGN PATENT DOCUMENTS

| | | | |
|---|---|---|---|
| 1005208 | 12/1951 | France | 100/117 |
| 737446 | 6/1980 | U.S.S.R. | 100/117 |

*Primary Examiner*—Peter Feldman

*Attorney, Agent, or Firm*—Eugene F. Malin

[57] ABSTRACT

A system for improving the operating efficiency of screw presses which express fluids from fibrous material. This system includes a plurality of worm sections and collars and a hollow main shaft. Fluids are allowed to pass into the hollow shaft through one or more screen bar sections, fitted over the collars. The area of the collar housing beneath the screen bars is generally funnel-shaped toward the longitudinal rotational axis of the shaft, having a drain opening near the apex of the funnel configuration to allow expressed fluids to exit into the hollow drive shaft or into a conduit therein. The worm flights may include hardened wear resistant inserts in the outer peripheral surface which may be integrally cast into the worm section. The worm sections which mate to form a single divided worm may be identical and therefore reversible to reduce production and inventory costs. As part of this system for improving efficiency, these dividable worms are now removable separately through the side of the press after the cage has been removed.

9 Claims, 6 Drawing Figures

SYSTEM FOR IMPROVING EFFICIENCY OF SCREW PRESSES

BACKGROUND OF THE INVENTION

This invention relates to screw presses and particularly to high pressure expressing presses capable of continuous operation, and to improvements in both operating efficiency and reduced maintenance time. Screw presses, which are used to express oils or fluids from fibrous materials such as sugar cane, meals, nuts, bagasse, rubber, and the like, include a main body or cage with drainage openings through the cage side walls, and a feed worm rotationally driven within the cage to express the fibrous contents therein. Several U.S. Patents disclose such presses: U.S. Pat. Nos. 2,902,923; 3,037,445; 3,070,003; 3,086,452; 3,092,017; 3,093,065; 3,111,080; 3,246,597; 3,382,538; 3,518,936; 3,574,891; 3,592,128; 3,721,184; 3,797,891; 4,117,776.

The cage is capable of holding materials therein compressed under high pressures. As the material is fed into the intake chute, pressure is exerted upon it by a series of pressure worms which include screw flights which are mounted on and rotate along with the main drive shaft. The shaft onto which the worm is mounted extends longitudinally through the cage, such that the screw flights, a part of the worm, have a close fit with the press housing and walls of the cage, and, as such, when the shaft is rotated, the flights press the fibrous material toward the discharge end of the press. One or more breaker bars or equivalent stationary members protrude inwardly from the cage in areas not in conflict with the pressure worms to afford a restriction and barrier to helical-type flow of the pressed material. Internally the press is capable of continuously maintaining this high pressure to express the liquid from the fibrous plug.

The purpose of an expressing press is to extract the maximum amount of fluid from the fibrous pressed material. Therefore, the percent of fluids remaining in the exit material is the most pertinent gauge of press efficiency. By increasing the exit pressure, that is, by additional choking of the discharge, or by increasing the feed while maintaining a fixed press speed, the amount of dewatering can be somewhat increased. However, there is a practical limit beyond which overall press efficiency drops due to overstress on certain critical parts, such as the drive train, worms and cage screens. By studying the moisture profile of the exiting fiberous plug, it has been found that the highest percent of fluid is contained in the fiber nearest the rotational axis of the main shaft. Increased liquid removal of entrapped fluids contained within that inner portion of the fibrous plug has been thus far limited to variations in the above operational parameters.

In such presses the outer surfaces of the worm flights forming the screw are often hard-coated to reduce wear on peripheal edges of the flights, where wear is usually most severe. The hard-coating operation is commonly performed by welding a layer of material such as "Stellite", or "Stoody", available commercially, onto the outer peripheral surface of each worm flight, after which the material is ground to bring each worm flight within predetermined final dimensions and surface finish. Frequently, after a screw press has had extensive use, even these hardened edges become worm resulting in a significant reduction in operating efficiency. Such wear is particularly severe when pressing materials contain sand, gravel and other foreign abrasive materials, as they frequently do.

Worm failures may also result from impact of a section of the flight with a relatively large foreign object, which frequently is introduced into the press along with the conveyed feed material. This impact can result in the fracture of all or a part of the flight from the worm body. Any resultant fragment can, in turn, cause further breakage of other flight sections on subsequence worms. This flight fracturing condition is accented by the introduction of stress boundries in the base metal during the weld build-up or hard-coating materials previously described. Improvements described in U.S. Pat. No. 3,596,128 issued to French Mill Oil Machinery comprising replaceable flight surfaces further increase the possibility of this type failure by including into the aforementioned flight sections indentures or anchorments such as bolting holes, slots, cutouts, etc.

When such failures occur, the cage must be opened and the defective worm removed from the pressing chamber. The flights are then replaced or reconditioned by again welding a hard-coating material on their peripheral edges then reground to original dimensions. In the case of flight fracture, the reconditioning process requires that the entire flight be ground down and replaced after which multiple coats of hard-coating are welded to this new base. This reconditioning of the worm flights may require significant downtime of the press if spare replacements are not available, resulting in substantial lost operating time.

The main shaft is essentially supported in cantilever fashion at the drive end, which is also the infeed end of the press. Except for those improvements described in U.S. Pat. No. 3,592,128, whenever a worm or collar requires maintenance or replacement, that member must be removed from the free end of the main shaft, which is located at the discharge end of the press. Therefore all worms and collars located downstream of the member to be serviced must also be slid off the shaft. Although facilitated by removal of the cages, this worm and collar removal and later reassembly procedure is very laborious and time consuming.

Some expressing presses perform the dual function of removing fluids from the fibrous material and serving as the entrance point for conveying the expressed fibrous material into a further process which may operate at considerable temperature or pressure or both. When worm replacement is required under these conditions, worms and collars have to be removed from the shaft through this additional chamber after limited cooling. Workmen entering this chamber to facilitate this removal do so under somewhat difficult and dangerous conditions.

The present invention provides a system for substantially reducing downtime maintainance time and costs. An additional feature includes an improved means for extracting fluids from the fibrous material, thereby increasing operating efficiency of these presses.

BRIEF DESCRIPTION OF THE INVENTION

An improved screw press comprising means for removing expressed fluids from fibrous material therein through openings provided in each collar mounted onto the main drive shaft and an improvement in maintaining these screw presses. In addition to fluid exiting radially outward, as previously provided, through gaps between individual screen bars which line a major portion of the inner surface of the outer cage member, expressed fluid as a result of the present invention may now exit radially inward through slits provided in the outer peripheral surface of the spacer collar between the worms. That fluid is carried away through the hollow drive shaft or a conduit therein.

The improved screw press maintanance feature includes a split worm members which were previously fabricated in one doughnut-shaped piece. This new bifurcated design, while maintaining sufficient operational strength, allows removal of individual feed worm segments without having to remove all downstream segments from the main shaft first. Removal is through the particular pressing chamber side opening subsequent to cage removal.

The collar portion of the worm assembly is now made integral to the hollow main drive shaft and includes means for the above radially inward fluid exit. This fluid exit means includes a plurality of screen bars which form the outer cylindrical surface of the collar. Narrow slits, similar to those formed by the screen bars which previously and continue to line the cage, provide the passage way through which the expressed fluids exit. After passing radially inward through these screen bar slits, the fluid is conveyed through the collar cavity and into the hollow drive shaft, then finally out of the shaft to a suitable storage container. The collar includes means to drive the worms, replacing previous keyway drive means, and also includes worm mounting bolt receptacles. The worm sections, when mateably mounted between the collars, serve to lock the new collar screen bars into operable position, forming the collar outer surface.

The worm flights may now be cast, thus taking advantage of improved wear-resistant casting metals. The periphery of the worm flights may also include very hard wear resistant inserts near the leading edge of the flight which may be integrally cast into the worm sections. Worm sections may be identical and therefore reversible if the collars are so mateably designed, thus reducing production and inventory costs.

It is therefore an object of this invention to provide increased efficiency in the operation of mechanical screw presses by the addition of fluid exit means in the collars between each worm, thus allowing radially inward fluid flow into the hollow main shaft.

It is another object of this invention to reduce the time required to maintain and service worms by providing bifurcated worms which are removable and replaceable through the side of the press with only removal of the appropriate cage.

It is yet another object of this invention to replace the previous worm-to-main shaft keyway drive means with a noval collar design which is integral to the main shaft.

It is still another object of this invention to provide a means for regularly purging the new fluid exit means of fiberous debris which has been forced between the new collar screen bars.

And yet another object of this invention is to provide improved wear resistance of the periphery of the worm flights by including hardened wear inserts therein.

A still further object of this invention is to reduce production and inventory cost of worms by providing identical mating worm halves, which may be made by casting.

In accordance with these and other objects which will be apparent hereafter, the instant invention will now be described with particular reference to the accompanying drawings.

PREFERRED EMBODIMENT OF THE INVENTION

Figure 1:
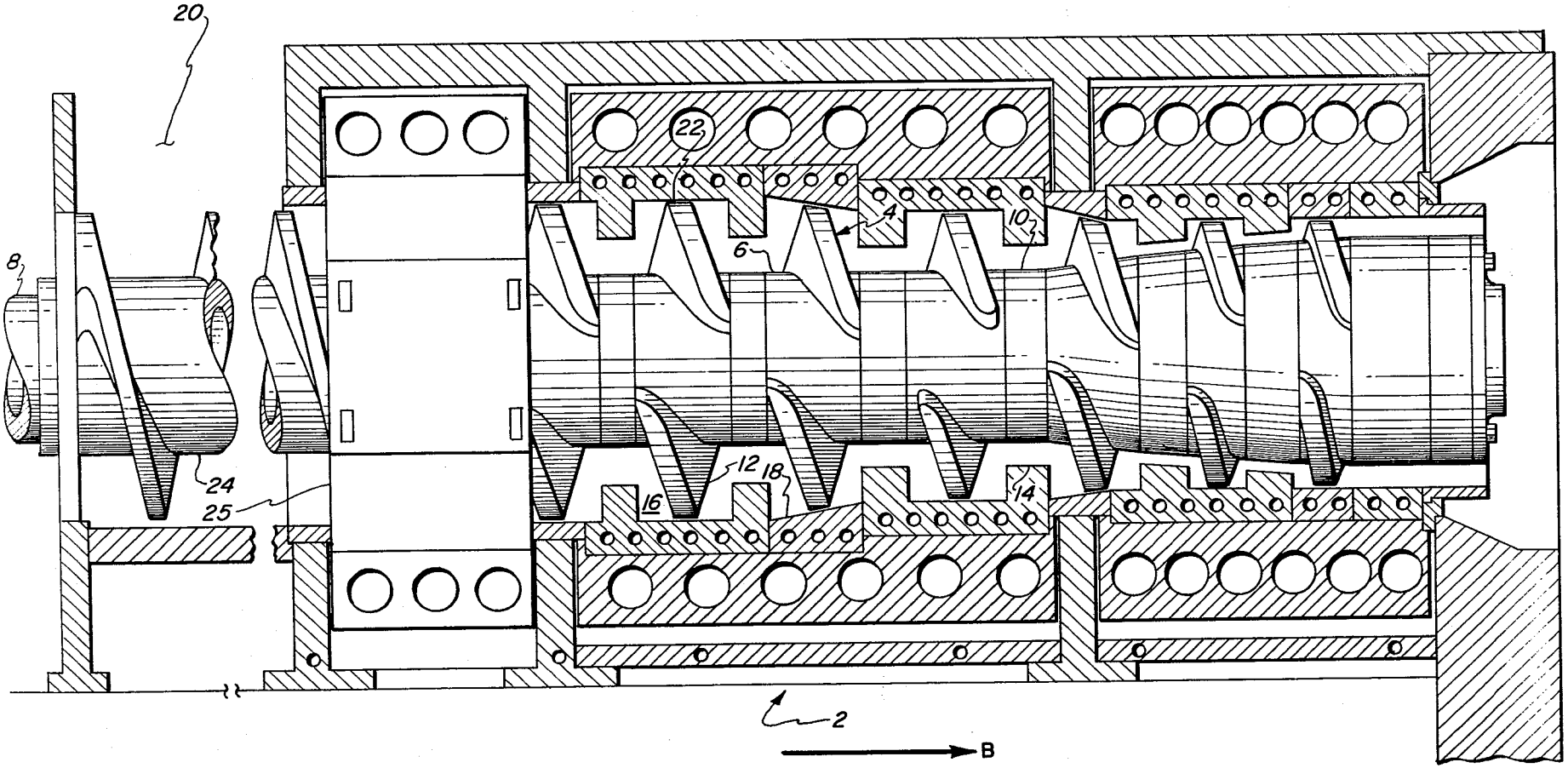
FIG. 1 PRIOR ART
FIG. 1 is a cross-sectional elevational view of a conventional mechanical screw press.

Referring now to the drawings and firstly to FIG. 1, a conventional mechanical screw press is shown generally at 2. The press has a feed worm 4 mounted over and held torsionally in place by keyway on main shaft 8, which may be hollow or solid. Feedworm 4 includes worms 6 and pressure collars 10 alternately positioned along the shaft. Each worm includes a flight 12 whose outer peripheral surface 22 is positioned in close proximity to housing 18.

The material to be expressed is loaded into the press through chute 20. Feed screw 24 then moves the loaded material along into the first pressure chamber 16. As the worms are rotated by the shaft, the material is moved along in the general direction of arrow B. As the material so moves, it is compressed due to the reduction in consecutive chamber sizes. The rate of feed is set by shaft speed and quantity of material loaded. Rotational flow restriction is created by breaker bars 14. Fluids expressed flow radially outwardly from the shaft and discharge through cage screen bars (not shown) on the inner concave surfaces of cages 25 (only one shown).

Figures 2, 3, 4, 5, 6:
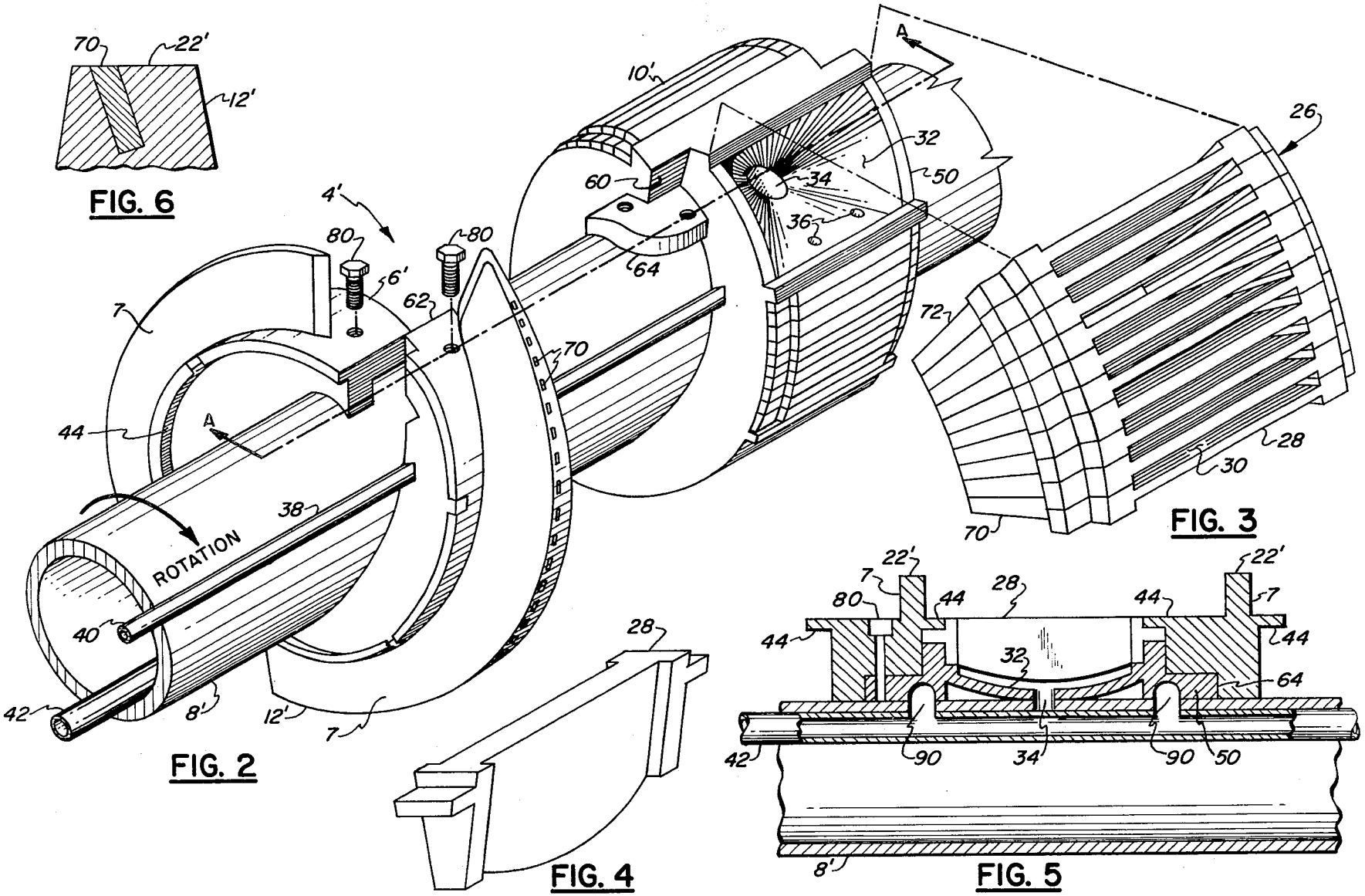
FIG. 2 is a perspective view of the entire invention including the main shaft, bifurcated worm, and integral collar and screen bars.
FIG. 3 is a perspective view of one section of collar screen bars.
FIG. 4 is a perspective view of one collar screen bar.
FIG. 5 is a sectional view through section A—A in FIG. 1.
FIG. 6 is a portional sectional view through the worm flight showing a hardened wear insert therein.

Referring now to FIG. 2, the improved feedworm is shown generally at 4' and includes worms 6' and collars 10' mounted on shaft 8'. Collar 10' includes a hollow collar housing 50, which is integral to the hollow shaft 8', and a plurality of screen bar sections 26, which mateably fit onto the collar housing to form the outer cylindrical surface of the collar 10'. The screen bar section 26 is also shown in FIG. 3 to include a series of screen bars 28 (FIG. 4) which when placed adjacent one another, form slits or openings 30 between each bar in a manner similar to that of cage screen bars described in U.S. Pat. No. 3,093,065. These openings allow expressed fluids to exit from the pressuring chamber into the hollow collar housing, from which the fluid is then conveyed into the interior of the hollow shaft through opening 34. The amount of clearance or relief is considered critical, but varies to provide the optimum relief for the specific product that is to be run in the press. If the provided clearance is too great the hollow spacer housing may become jammed with unwanted solids, extruded from the fiberous plug of material being processed through the press. If the clearance is insufficient the drainage slots will plug, or restrict the flow of fluids, thereby reducing the efficiency of the press. The bottom portion 32 of the collar housing is shaped to aid expressed fluid in entering hollow shaft by taking advantage of rotational inertia forces. Fluid entering the hollow main shaft may be conveyed away using the main shaft itself as a conduit. The screen bars have a tapered configuration along edges 70 and 72, which are sized so that the outer surfaces of the bars conform with the outside diameter of the hollow collar housing 28 when the screen bars are placed side by side, thus also providing support for adjacent screen bars.

Each worm 6' comprises two identical worm sections 7, each mounted on and surrounding approximately one half of the main shaft. These worm sections align on the shaft in spiral fashion so that the ends of each worm section do not fully abut each other at surfaces 62 but are somewhat offset. This spiral type offset mateably engages against the end surface 60 of the collar housing so that a continuous cylindrical surface is formed of a larger diameter than the main shaft. As shown in FIG. 5, each worm section 7 is held onto the shaft by bolts 80 which threadedly engage into a portion 64 of the collar housing and may also so engage the main shaft. After the worm sections are bolted in place, lips 44, integral to each worm section, serve as position retainers for the screen bars. The screen bars may receive additional strength to resist deflection due to chamber pressure by mateable contact with a portion of the bottom surface 32 of the collar housing but not so as to inhibit flow of fluids or purging of debris.

Referring again to FIG. 2, surface 60 of the collar housing mateable engages surface 62 of the worm section when the feed worm is fully assembled. This engagement provides the means for rotating the worms along with the shaft and collar housing and provides the torsional strength required to express the material within the press. This intercommunication serves to replace the previous conventional keyway drive means for worms (and collars). The outer peripheral surfaces 22' of the worm flights 12' may include tungsten carbide wear inserts 70, also shown in FIG. 6, which may be integrally cast therein. These inserts provide additional wear resistance to the abrasive effects of debris such as sand, gravel, rocks or the like included with the material to be expressed.

Because a certain amount of fiberous material and debris will be forced between the screen bars through slits 30 in addition to expressed fluids and because the normal flow of expressed fluids may not be sufficient to clear that debris from the collar housing out through opening 34, a debris purging means may be included in this system. This purging system includes a purging conduit 40 or 42 in FIG. 2 to convey a suitable gas or fluid, somewhat under pressure, into the hollow collar housing through inlets 36. Holes 36 are positioned in relation to the contour of surface 32 and to the location of opening 34 therein so as to enhance the debris purging action and outflow through exit opening 34.

Two alternate purging conduits 40 and 42 are disclosed. Conduit 40 lies along the pathway created by removal of the drive key at 38 and is suitably connected to inlets 36 by interconnecting passageways beneath collar bottom surface 32. Conduit 42 is also longitudinal to the drive shaft, but is internal thereto, attached to the inner surface of the shaft. Conveyance of the purging gas or fluid to inlets 36 into a plurality of hollow collars is by circumferential cavities 90 in FIG. 5 within the inner cylindrical surface of the collars which serves as a distribution means to all of the collar hollow chambers. Conduit 42 is positioned within the shaft so as not to obstruct opening 34 into the center of the shaft.

Some presses are also used as an airlock. In this situation, well known means (not shown) are employed to allow pressure and fluid to escape in limited quantities through the openings provided at the distal end of the main shaft through pre-sized orifices.

The instant invention has been shown and described herein in what is considered to be the most practical and preferred embodiment of the invention. It is recognized, however, that departures may be made therefrom within the scope of the invention and that obvious modifications may occur to a person skilled in the art.

What I claim is:

1. High pressure mechanical screw press system for removal of fluids from organic materials such as sugar cane, meal, nuts, bagasse, and other materials including a hollow main shaft, at least one pressure chamber, feed worm with a plurality of worms and collars arranged on the hollow main shaft, said worms having flights thereon, securing means for securing the worms and collars on the hollow main shaft, the worm flights, rotationally driven by the hollow main shaft to press fluids from the material within at least one pressure chamber, said system comprising:

said hollow main shaft having a relatively large conduit therethrough and a relatively thin wall thickness, said hollow main shaft having a plurality of conduit means through said thin wall;

an inwardly directed means for removing at least some of the pressed fluids out of the pressure chamber;

said collars including said inwardly directed means;

said collars and said inwardly directed means aligned with said conduit means to provide direct fluid drainage into said hollow main shaft;

said collars connected directly onto and about said hollow main shaft to provide structural support for said hollow main shaft with the relative large conduit.

2. A system for increasing the operating efficiency of a mechanical screw press used for removal of fluids from organic materials such as sugar cane, meal, nuts, bagasse, and other materials, including a hollow main shaft, at least one pressure chamber, a feed worm with a plurality of worms and collars arranged on the hollow main shaft, said worms having flights thereon, securing means for rotationally securing the worms and collars on the hollow main shaft, the worm flights, rotationally driven by the hollow main shaft, press fluids from the material within at least one pressure chamber, and cage means surrounding the feed worm allowing the fluids to escape radially outward from at least one pressure chamber, said system comprising:

said hollow main shaft having a relatively large conduit therethrough and a relatively thin wall thickness, said hollow main shaft having a plurality of conduit means through said thin wall;

an inwardly directed means for removing some of the pressed fluids through said collars and into said hollow main shaft;

said collars including said inwardly directed means for removing some of the pressed fluids, a plurality of elongated screen bars; and at least one opening within each of said collars, said opening fluidly connected to said conduit means in said hollow main shaft;

said screen bars of such configuration that, when placed side by side, form a cover for each of said collars;

each said cover having slits formed between each of the adjacent said screen bars;

said slits for allowing pressed fluids to exit from said pressure chamber into said collars, then through said opening into said hollow main shaft;

said screen bars and said slits therebetween for preventing the material from exiting from said pressure chamber;

said securing means for rotationally securing said worms and said collars onto the shaft is a keyway and mating key;

said worms and said collars slidably engageable onto the shaft and said key.

3. A system as described in claim 2 wherein, said worms including at least two worm portions, each said worm portion surrounding 180 degrees or less of the circumference of said shaft, and means for removably retaining each of said worm portions on said shaft;

said pressure chamber including a removeable side and said cage means is a removeable cage means;

said worm portions are removeable from said hollow main shaft through said side of said pressure chamber after said cage means removal.

4. A system as described in claim 3 wherein:

said collars are rigidly attached to the outer surface of said hollow main shaft.

5. A system as described in claim 2, wherein:

said collars are hollow, rigidly attached to the outer surface of said shaft, and have at least a portion of the outer cylinder surface removed, at least one opening within each said hollow collar and into said hollow main shaft.

6. A system as described in claim 5, wherein:

each of said worms are segmented into at least two worm portions;

each of said worm portions surrounding 180 degrees or less of the circumference of said shaft;

each of said worm portions are removable from said main shaft.

7. A system as described in claim 2, wherein;

the outer peripheral edge of said worms flights include a plurality wear-resistant inserts;

said inserts for increasing the time duration between worm maintenance.

8. A system as described in claim 2 further comprising:

a debris purging means, said purging means for removal of pressed material inadvertently passing between said screen bars and into said hollow collar.

9. A system as described in claim 8, wherein;

said purging means including at least one purging aperture in each said hollow collar;

a source of pressurized purging liquid;

a conduit connecting between said purging aperture and said source of purging liquid; and a means for controlled intermittent interruption of the conveyance of said pressurized liquid to said collar purging aperture.

* * * * *